US005209277A

United States Patent [19]

Grüne et al.

[11] Patent Number: 5,209,277

[45] Date of Patent: May 11, 1993

[54] APPARATUS FOR NON-DAMAGING PACKAGING

[75] Inventors: Helmut Grüne; Manfred Nordmeyer; Jens Quirling, all of Schwarmstedt, Fed. Rep. of Germany

[73] Assignee: Lieder Maschinenbau GMBH & Co. KG, Schwarmstedt, Fed. Rep. of Germany

[21] Appl. No.: 598,379

[22] Filed: Oct. 15, 1990

[30] Foreign Application Priority Data

Oct. 13, 1989 [DE] Fed. Rep. of Germany ..... 3934323
Oct. 17, 1989 [DE] Fed. Rep. of Germany ..... 3934518

[51] Int. Cl.[5] ..... B67C 3/26

[52] U.S. Cl. ..... 141/250; 141/266; 222/368; 222/306

[58] Field of Search ..... 141/258, 259, 260, 261, 141/67, 81, 250, 266, 284; 222/368, 306; 414/189, 219

[56] References Cited

U.S. PATENT DOCUMENTS

| | | | |
|---|---|---|---|
| 2,820,577 | 1/1958 | Winters et al. | 222/306 |
| 3,656,518 | 4/1972 | Aronson | 141/81 |
| 4,622,208 | 11/1986 | Namba et al. | 141/67 |
| 4,905,744 | 3/1990 | Siegrest | 141/261 |
| 4,991,632 | 2/1991 | Nordmeyer et al. | 141/177 |

FOREIGN PATENT DOCUMENTS

| | | | |
|---|---|---|---|
| 1461982 | 3/1969 | Fed. Rep. of Germany | 141/81 |
| 2094268 | 9/1982 | United Kingdom | 141/258 |

*Primary Examiner*—Henry J. Recla
*Assistant Examiner*—Steven O. Douglas
*Attorney, Agent, or Firm*—Peter K. Kontler

[57] ABSTRACT

An apparatus for the non-damaging packaging of a product whose consistency can be effected by outside influences, has at least one metering container that is rotatably supported in a housing. The housing has an inlet cross section, through which during the filling operation, the product can slide into the metering container and which after the metering container has been rotated, is turned towards the packaging unit that is to be filled as an outlet cross section. The metering container is of a cross section that is constant throughout its whole length, and which is configured symmetrically to a mid-line axis that extends through the metering container and which extends approximately in a vertical direction during the filling operation. The metering container has a space content that is variable with regard to its size. The metering container has a bottom that is so supported as to be movable along the mid-line axis, and which is opposite the inlet cross section in the direction of the product entering through this.

45 Claims, 10 Drawing Sheets

Figure 1:
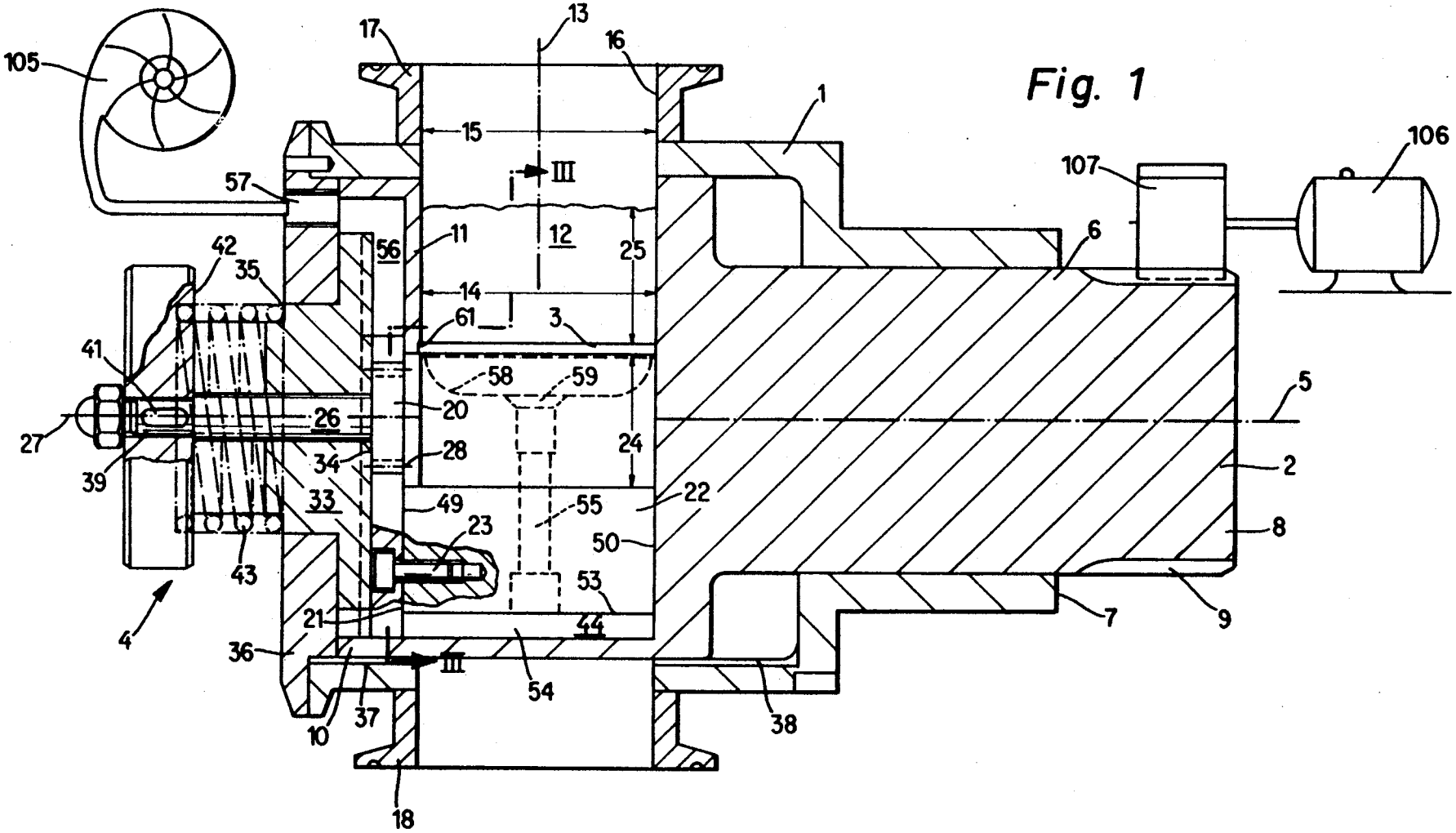

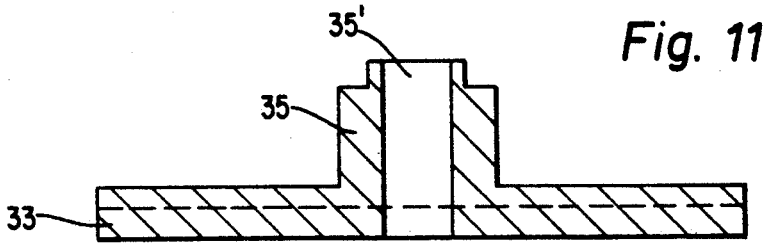
Fig. 11
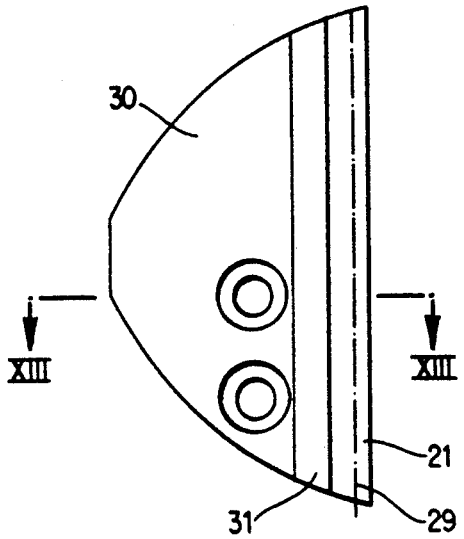
Fig. 12
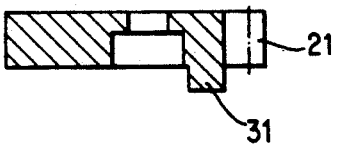
Fig. 13
Fig. 14
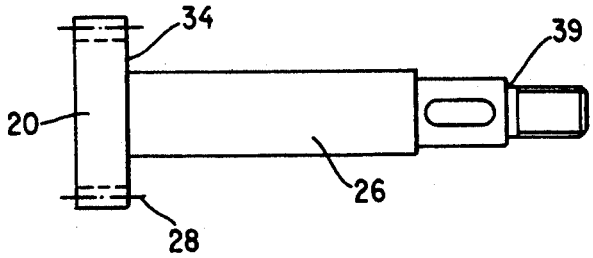

APPARATUS FOR NON-DAMAGING PACKAGING

The present invention relates to an apparatus for the non-damaging packaging of a product, the consistency of which can be affected by outside influences, this incorporating at least one metering container that is so installed in a housing as to be able to pivot, this container having an inlet cross section through which the product moves into the metering container during the filling operation and which after the filling of the metering container has been completed, is turned towards a packaging unit that is to be filled, as an outlet cross section.

Apparatuses of this kind have proved themselves in practice. In view of an increasing requirement for products that are to be packaged, however, there was a need to accelerate the method of operation of apparatuses of this kind. In this connection, it had to be borne in mind that for purposes of non-damaging processing, the product could only be delivered to the apparatus in free fall. This meant that the metering container could only be incompletely filled, on the one hand, and on the other hand could only be emptied with difficulty, since its interior space was not well enough organized for both receiving and dispensing the product, but incorporated irregularities that, on the one hand, prevented complete filling of the metering container and, on the other hand, prevented the complete discharge of the product towards the packaging unit.

For this reason, it is the task of the present invention to so improve an apparatus of the type described in the introduction hereto that the unhindered filling and emptying of the metering container is made possible.

According to the present invention, this task has been solved in that the metering container is of constant cross section along its total length, this cross section being configured symmetrically to a mid-line axis that extends through the metering container and runs in a vertical direction during the filling operation. This constant cross section can easily accommodate the product that is to be filled and ca dispense it again without difficulty. Within the metering container there are no irregularities which, on the one hand, do not completely accommodate the product and, on the other hand, do not discharge it once again at the desired points in the cycle of operations. Complete filling and emptying of the metering container is possible at the desired points in the cycle of operations In this way it is possible to guarantee very high metering accuracy at relatively high operating speeds. Furthermore, the metering container can be easily produced and the apparatus can be installed in a very simple manner without the need to impose excessively high demands on the machining accuracy with which the metering container is to be manufactured.

According to a preferred embodiment of the invention, the metering container can have a variable capacity content with reference to its size. In this way, using the metering container, it is possible to fill quantities of the product that are of varying size and to do so with a high degree of accuracy. The adjustment of a particular capacity content is possible with such accuracy that a filling volume that is required for the packaging can be achieved at an accuracy that departs by less than 1% from the quantity that is to be dispensed.

According to a further referred embodiment of the present invention, the metering container has a bottom that can be displaced along the mid-line axis and which is opposite the inlet cross section in the direction of the product that enters through this cross section. Because of the displaceability of this bottom, the desired volume of the material that is to be packaged can be precisely adjusted and metered. Furthermore, this bottom can be moved along the mid-line axis of the metering container to any desired level, since the metering container is of a constant cross section. This can be both rectangular or circular. For reasons of simpler production, as a rule a circular cross section is preferred.

According to a further preferred embodiment of the present invention, the metering container is filled with the help of a filling hopper that is configured in the form of a tilting hopper, the outlet spout of which, when the filling hopper is tilted, runs in a direction that dispenses the product, and when not tilted runs in a direction that permits the product to flow from a hopper space. A tilting hopper of this kind prevents a large quantity of the product constantly being subjected to the action of a conveyor system, which could possibly change a product whose consistency can easily be affected into an undesirable state. This tilting hopper permits portioning of the product, which keeps the individual quantities of the product that are to be packaged so small that rapid packaging of the product after it has been divided into portions is ensured. The tilting hopper operates in such a manner that it does not damage the product, whereby during each tilting phase it loosens the product and thus simultaneously enhances the degree to which it is mixed.

According to a further embodiment of the present invention, the tilting hopper incorporates a hopper space which, when the hopper is tilted, is of a shape that prevents the product from flowing into the dispensing pipe. In this way, when the hopper is tilted, the product remains as the contents of the hopper and only that portion of the product that is in the area of the dispensing pipe is removed from the hopper space. Depending on the dimensions of the dispensing pipe, this part can be packed rapidly and carefully after leaving the hopper space.

Figure 2:
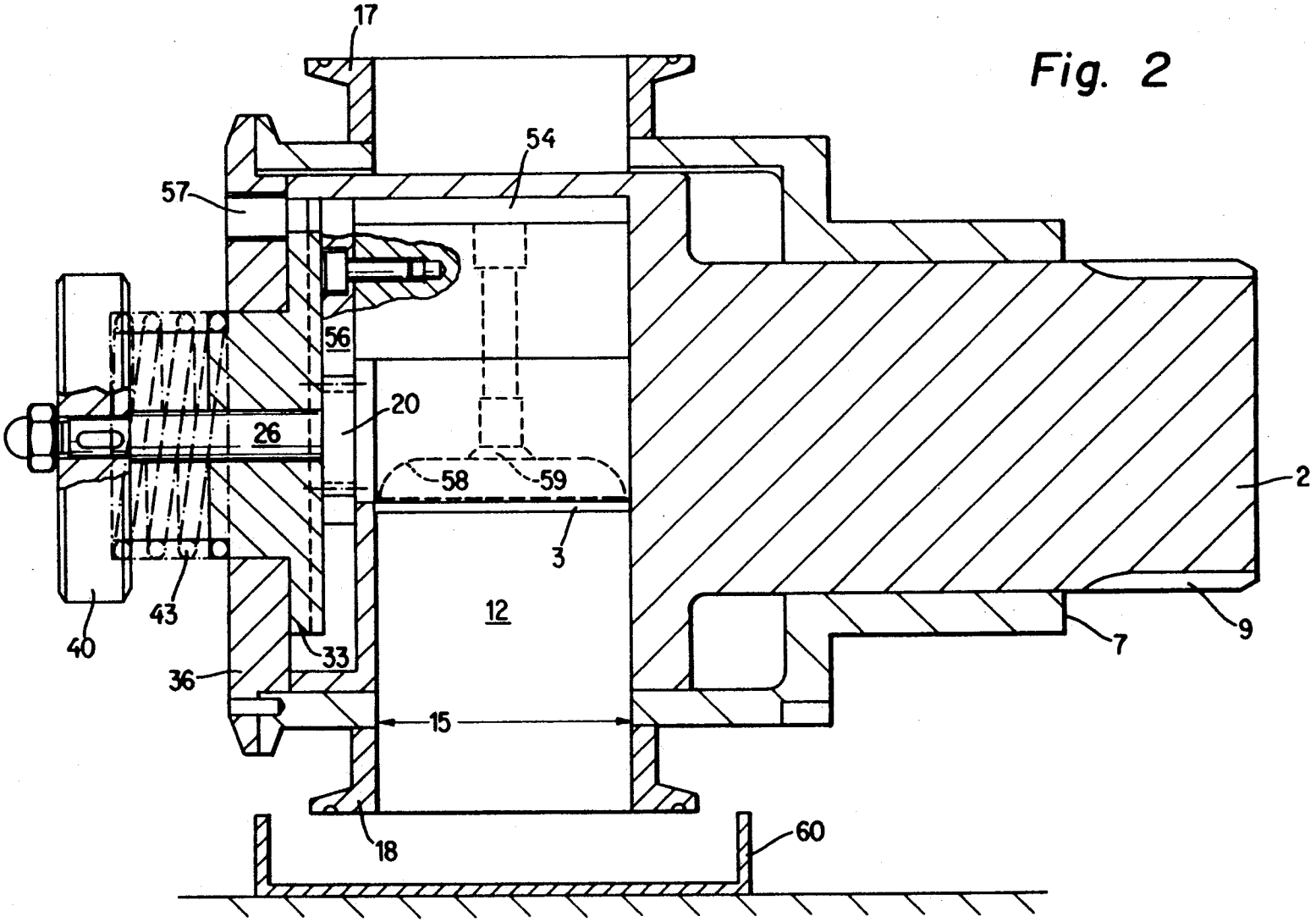
Figure 4:
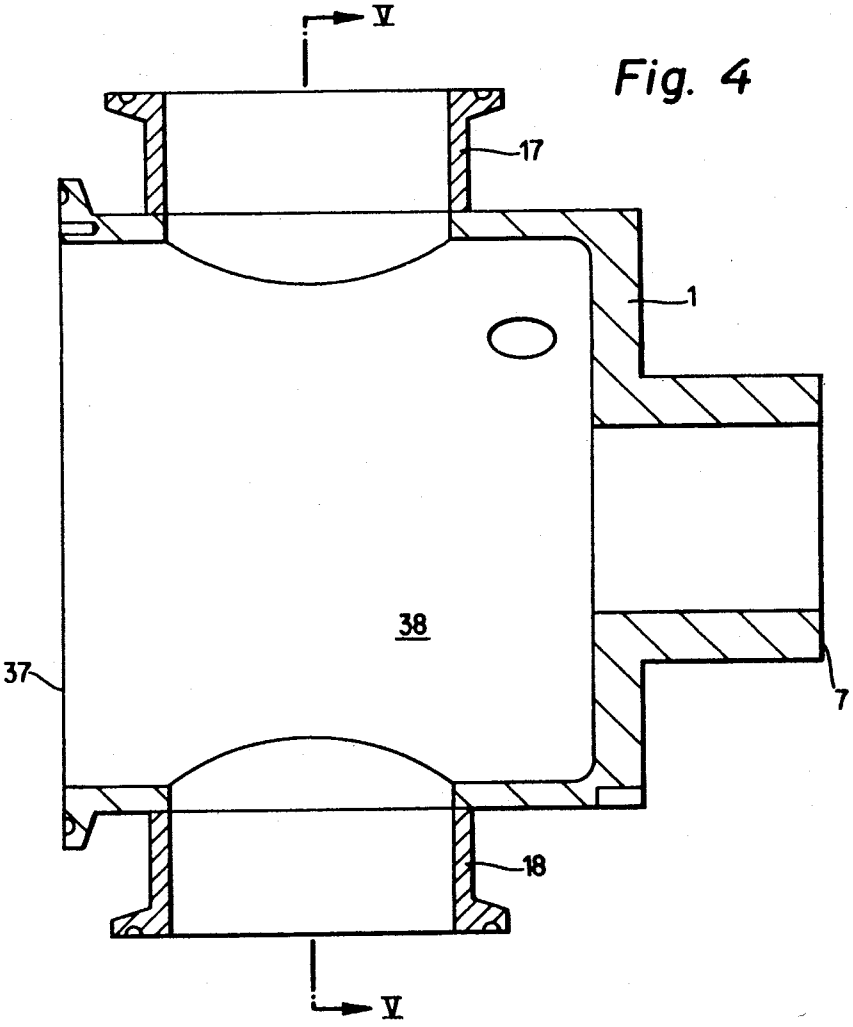
Figure 3:
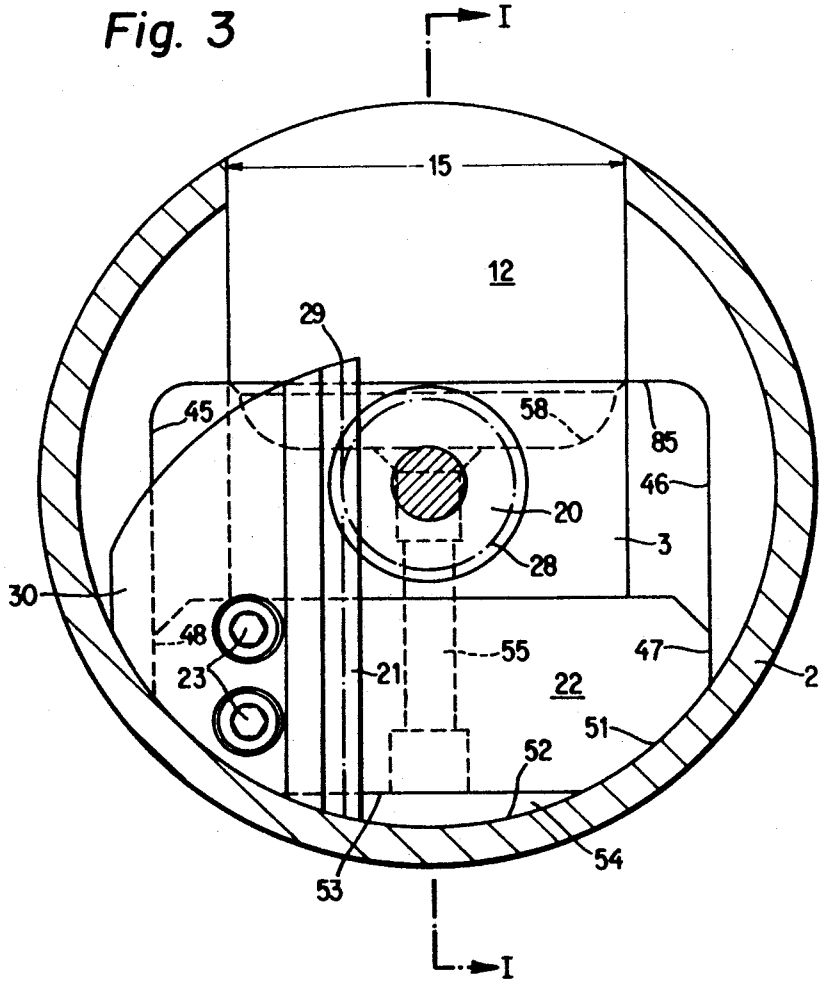
Figure 5:
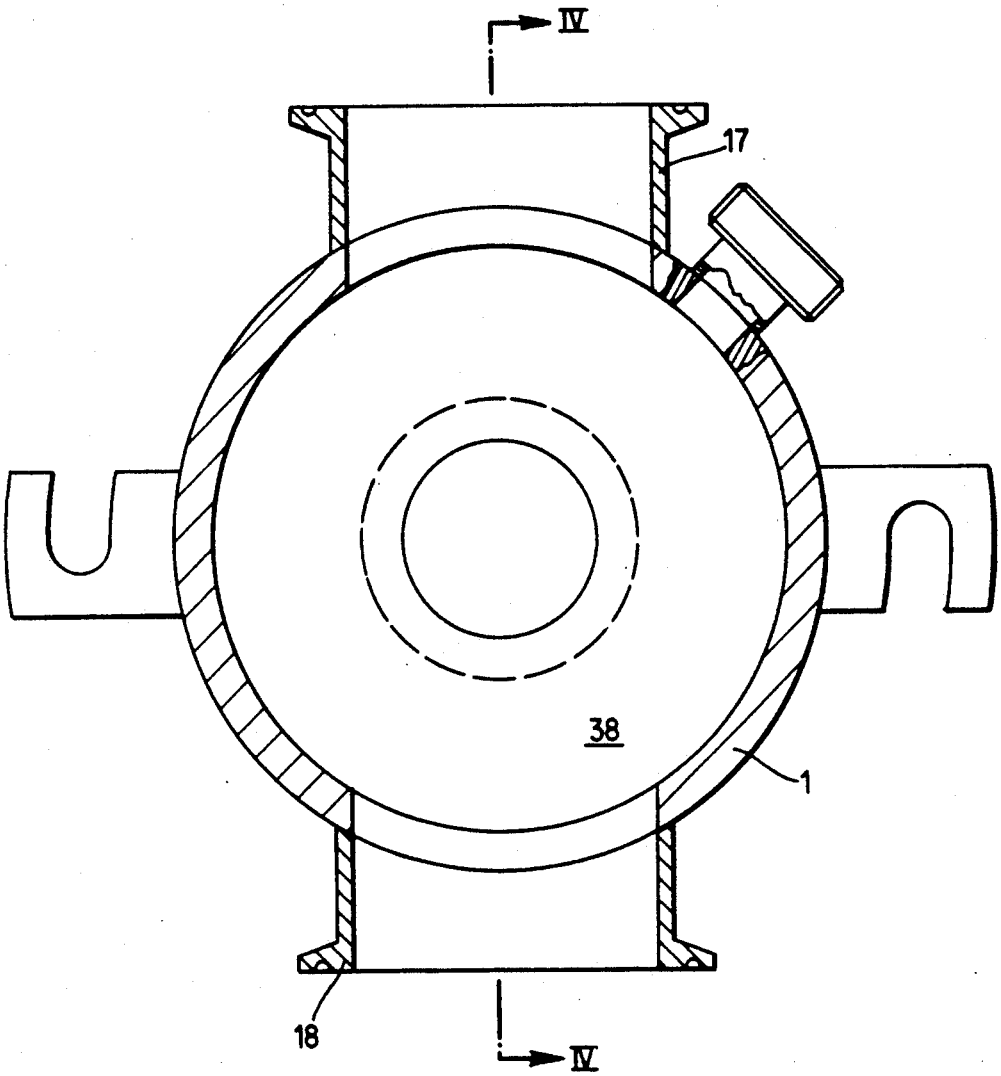
Figure 6:
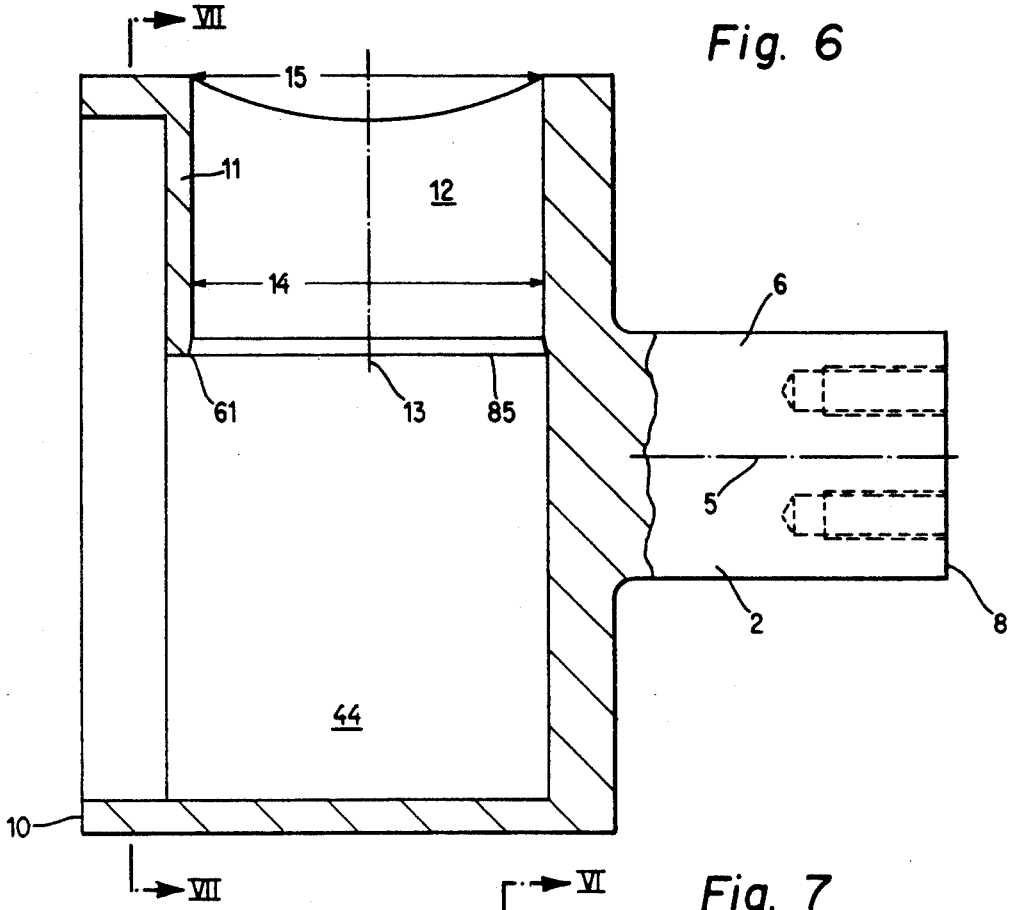
Figure 7:
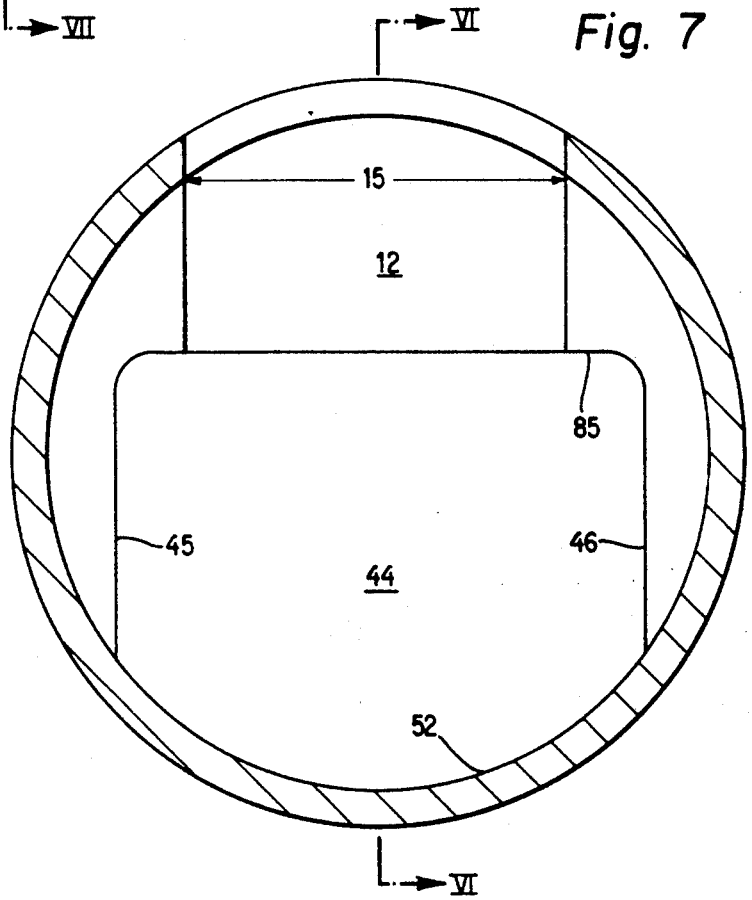
Figure 8:
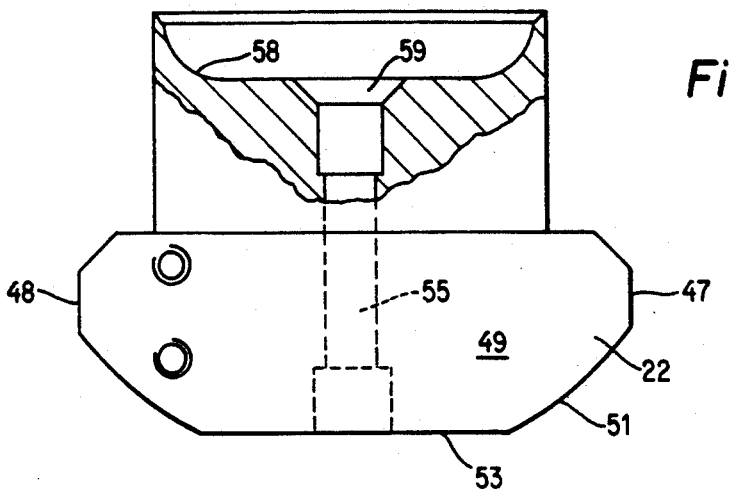
Figure 9:
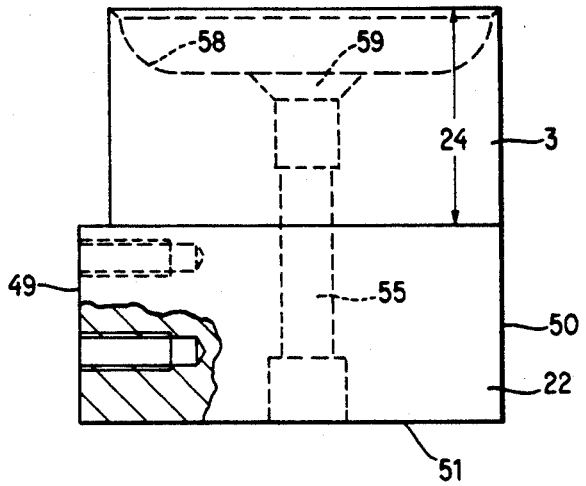
Figure 10:
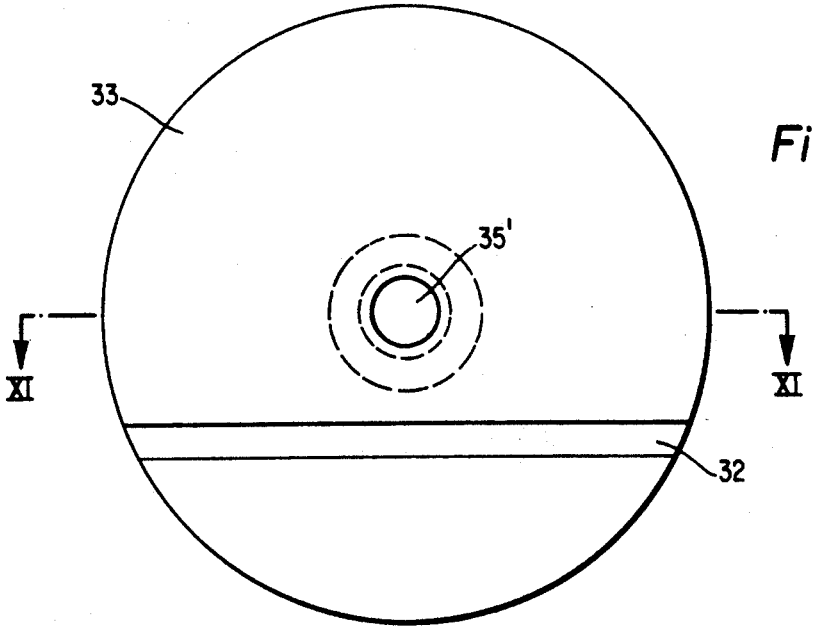
Figure 16:
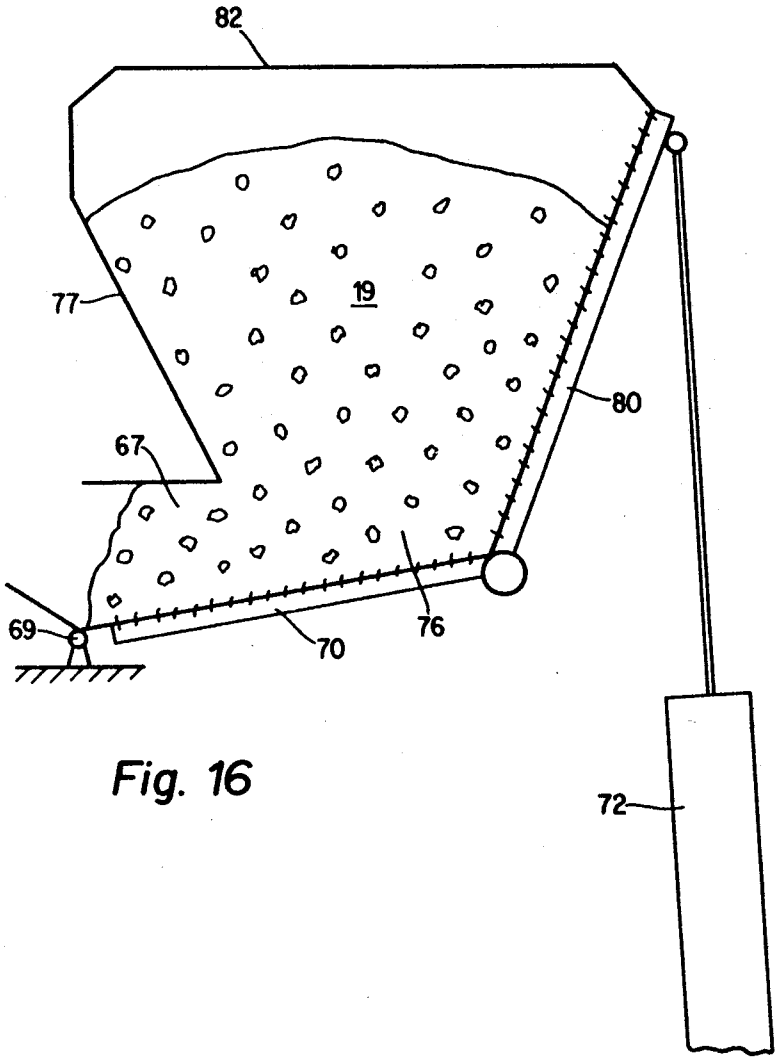
Figure 15:
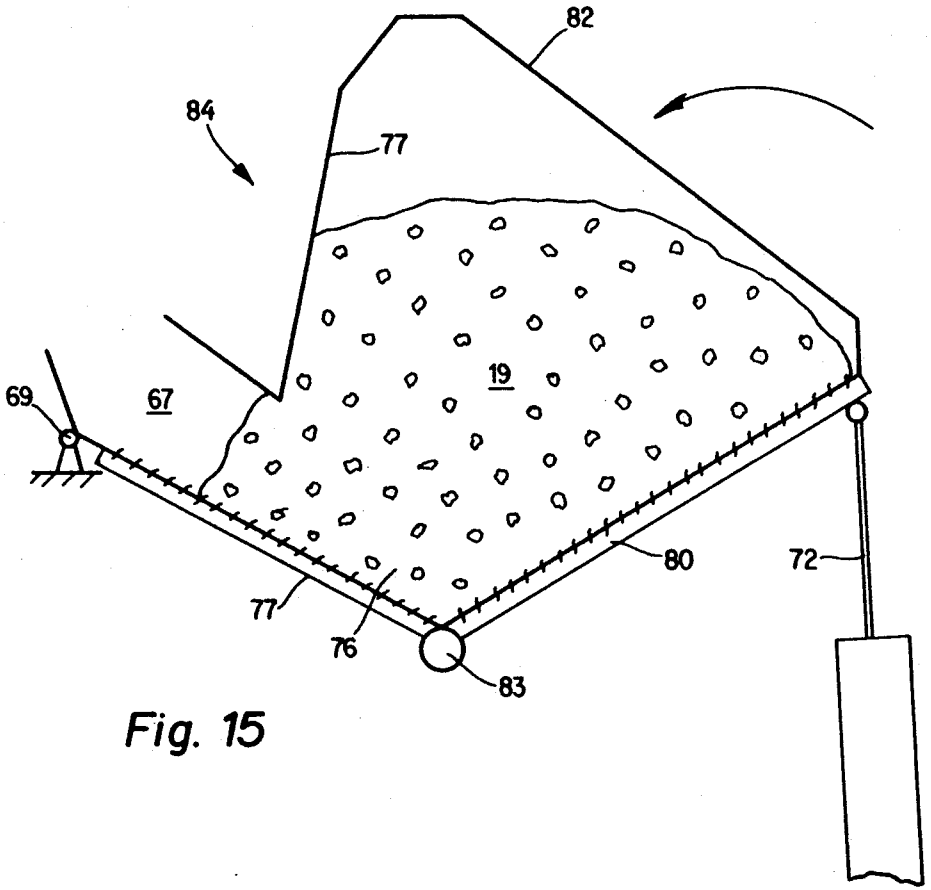
Figure 17:
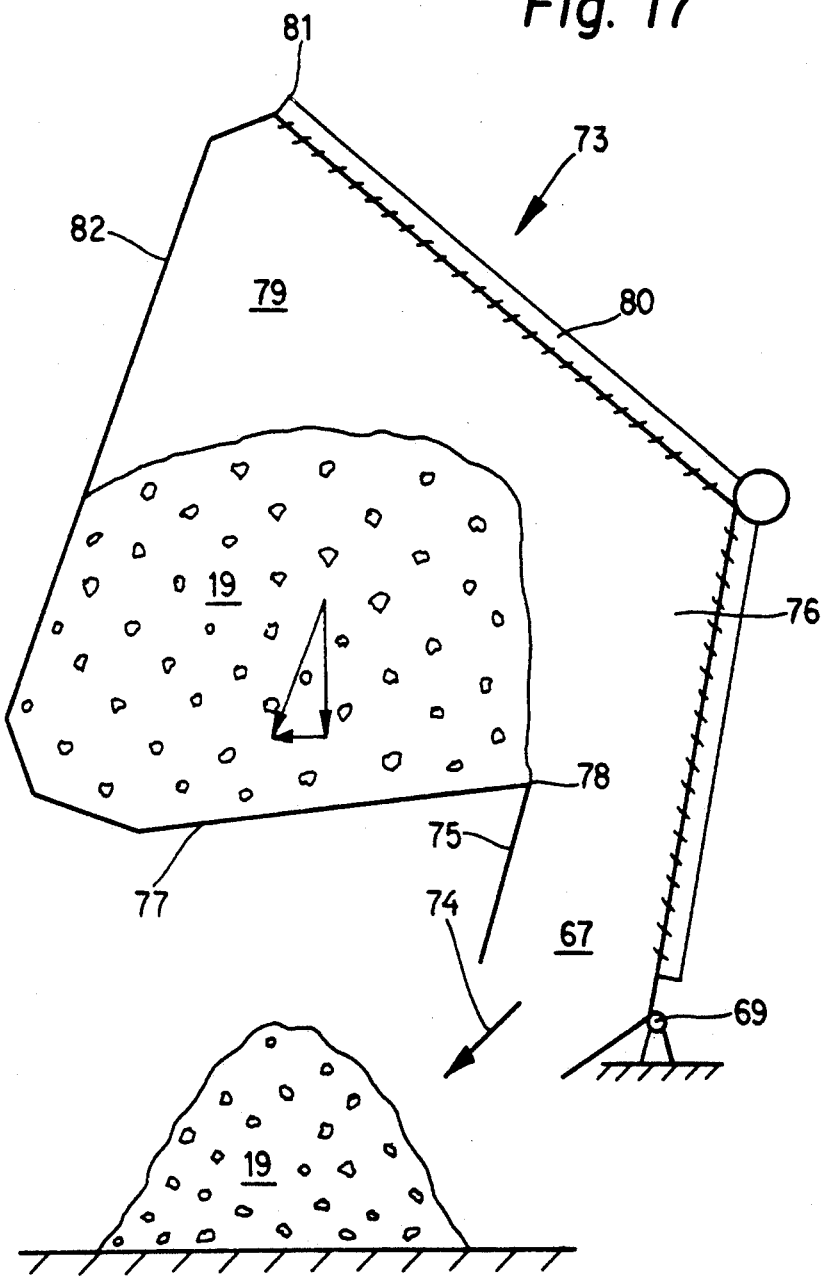
Figure 18:
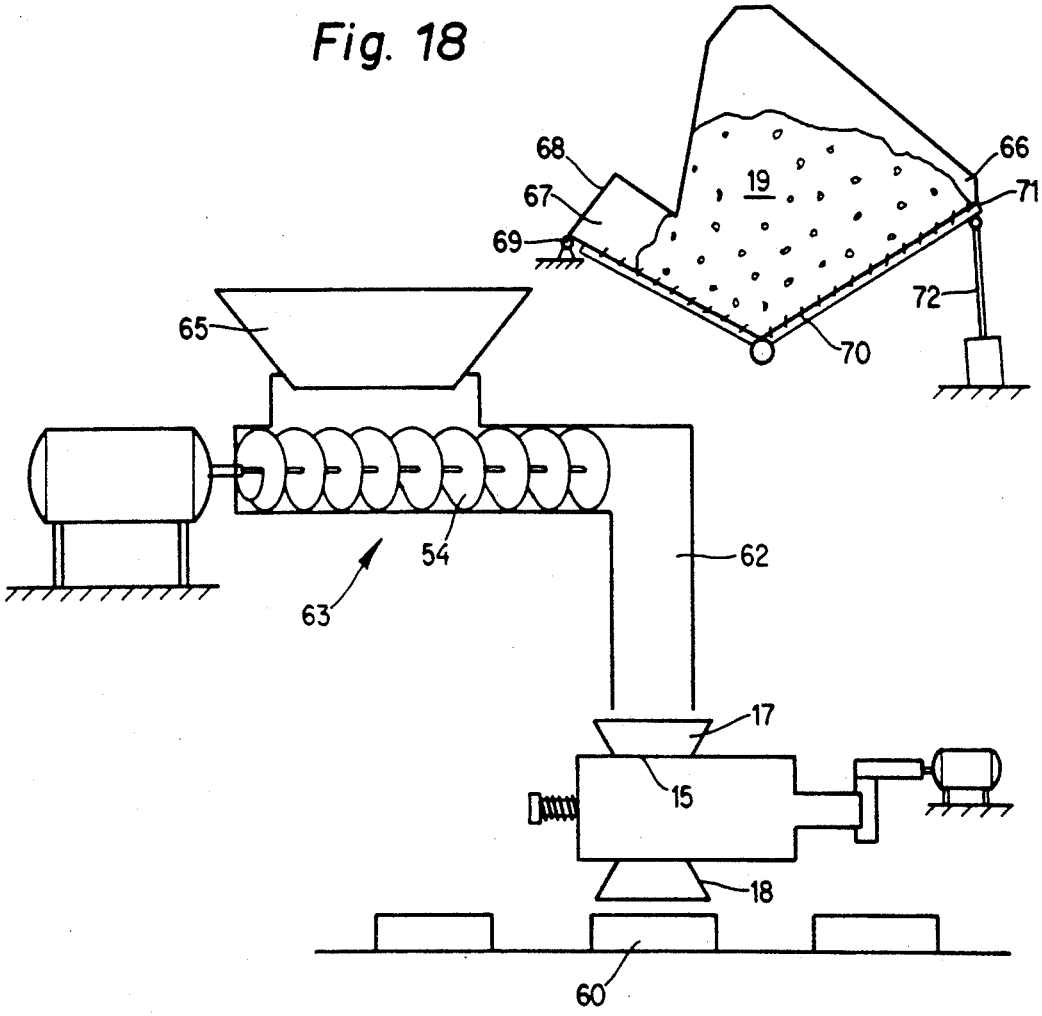

Further details of the present invention are described in the detailed description which follows and are shown in the drawings appended hereto in which a preferred embodiment of the present invention is illustrated by way of example. These drawings show the following:

FIG. 1: a longitudinal cross section through an apparatus, on the section line I—I of FIG. 3 through a rotary slide in the filling position;

FIG. 2: a longitudinal cross section through an apparatus as in FIG. 1, this showing the metering container in the dispensing position;

FIG. 3: a cross section through a rotary slide as on the section line III—III in FIG. 1;

FIG. 4: a longitudinal cross section through a housing on the section line IV—IV in FIG. 5;

FIG. 5: a cross section through a housing on the section line V—V in FIG. 4;

FIG. 6: a longitudinal cross section through a rotary slide on the section line VI—VI in FIG. 7;

FIG. 7: a cross section through a rotary slide on the section line VII—VII in FIG. 6;

FIG. 8: a partially cross sectioned side view of the bottom with its sub-structure;

FIG. 9: a side view of the bottom with its associated sub-structure;

FIG. 10: a plan view of a guide plate;

FIG. 11: a longitudinal cross section through a guide plate on the section line XI—XI in FIG. 10;

FIG. 12: a plan view of a toothed rack;

FIG. 13: a cross section through a toothed rack on the section line XIII—XIII in FIG. 12;

FIG. 14: a side view of a pinion with a drive shaft;

FIG. 15: a system sketch of a filling hopper in the filling position;

FIG. 16: a system sketch of a tilting hopper in a partially tilted position;

FIG. 17: a system sketch of a tilting hopper in a tilted position;

FIG. 18: a system sketch of an installation used for packaging products.

An apparatus for the non-damaging packaging of a product consists essentially of a housing (1), a rotary slide (2), a moveable bottom (3), and a slide drive (4). The rotary slide (2) is so supported in the housing (1) as to be rotatable about its longitudinal axis (5). This support is effected in the area of a pivoting shaft (6) that projects from one side (7) of the housing and which has a drive pinion (9) incorporated in its protruding end (8).

The rotary slide (2) has at its end (10) that extends into the housing (1), a metering container (12) that is enclosed by the walls (11) and which has a mid-line axis (13) that is more or less perpendicular to the longitudinal axis (5) of the rotary slide (2). The metering container (12) is so formed as to be symmetrical about this mid-line axis (13) and is of a circular cross section, having a diameter (14), that s constant relative to the length of the mid-line axis (13). The cross section, having a diameter (15), in the area of an outer diameter of the rotary slide (2) that is proximate to the housing (1) corresponds to this cross section (14). A cross section of an inner drilling (16) that extends through an inlet flange (17) and an outlet flange (18) and which extends transversely to the longitudinal axis (5) of the rotary slide (2) corresponds to the size of the inlet cross section (15). Within the metering container (12) the bottom (3) is so supported as to be moveable in the longitudinal direction of the mid-line axis (13). In this connection, the bottom (3) is so precisely matched and fitted in the metering container (12) that a product (19) that falls into the metering container (12) through the inlet cross section (15) remains on the bottom (3).

The slide drive (4) is provided to move the bottom (3) within the metering container (12); this is connected through a pinion (20) and a toothed rack (21) with the bottom (3). The toothed rack (21) is secured to a sub-structure (22) by means of mounting bolts (23) that extend from the toothed rack (21) into the sub-structure (22). The bottom (3) rises towards the metering container (12) on the sub-structure (22); this bottom is at a level (24) that fills the metering container (12) to a minimum filling volume (25).

The pinion (20) is secured to a drive shaft (26) that forms an extension (27) of the longitudinal axis (5) of the rotary slide (2). This ensures that the pinion (20) has a radius of turn (28) that is concentric with the mid-line axis (5). Thus, the longitudinal axis (29) of the toothed rack (21) extends displaced about the radius of turn (28), runs outside a plane of intersection formed by the longitudinal axis (5).

The toothed rack (21) is secured to a segment (30) that is secured to the sub-structure (22) of the bottom (3) by the mounting screws (23). A tongue (31) runs parallel to the toothed rack (21) on the segment (30), and this tongue extends across the whole segment (30) in the direction of the toothed rack (21) on that side of it that is remote from the pinion (20). The tongue (31) extends into a groove (32) that is formed on a guide plate (33). This guide plate (33) extends as a circular disk along a rear side (34) of the pinion (20) that is remote from the metering container (12), and is in contact on its rear side (34) with the guide plate (33). A bore or drilling (35') extends through the center point of this guide plate (33) and the guide plate (33) is mounted so as to be able to move on the drive shaft (26) through this drilling (35'). The guide plate (33) has a guide piece (35) with which the guide plate (33) is supported rotatably in a cover (36), with the help of which an opening (37) in the housing (1) is closed off. This opening (37) is opposite the side (7) of the housing (1). An interior space (38) within the housing (1) is accessible through the opening (37) so that the rotary slide (2) can be introduced into the interior space (38) through it; the inside diameter of the interior space (38) corresponds to the outside cross section of the rotary slide (2) in the area of the metering container (12).

The drive shaft (26) has a hand wheel (40) on its outer end (39) that extends from the housing (1); this hand wheel is connected rigidly to the drive shaft (26) through a key (41). When the hand wheel (40) is moved, the pinion (20) moves in such a manner that the toothed rack (21) and with its the sub-structure (22) also move. When the sub-structure (22) move,, the bottom (3) is simultaneously moved within the metering container (12).

Between the guide piece (35) and the rear side (42) of the hand wheel (40) that faces it, there is a compression spring (43) with the help of which the hand wheel (40) is held away from the guide plate (33). At the same time, the pinion (20) is pressed against the guide plate (33), so that there is a relatively large amount of friction generated between the pinion (20) and the guide plate (33), and this serves to support the pinion (20) against movements about the extension (27) of the longitudinal axis (5). In this way the pinion is prevented from rotating without there being an corresponding movement of the bottom (3) through the hand wheel (40).

The slide drive (4) is decoupled from rotatory movements that the metering container (12) makes about the longitudinal axis (5) with the help of the pinion (20) and the toothed rack (21). On the other hand, it is ensured that the movements of the bottom (3) in every tilt position of the rotary slide (2) take place along the mid-line axis (13), since the guidance of the bottom (3) is effected with the help of the tongue-and-groove system (31, 32). The guide plate (33) that is supported within the cover (36) so as to be rotatable ensures that the tongue-and-groove system runs parallel to the mid-line axis (13) of the metering container (12).

Furthermore, the sub-structure (22) is guided in an interior space (44) that is formed within the rotary slide (2). This interior space (44) is defined by side walls (45, 46) that are parallel to each other in plan and run parallel to the mid-line axis (13) of the metering container (12). The sub-structure (22) is guided on these walls (45, 46) with side boundaries (48, 47), each of which is defined by face surfaces (49, 50), that run essentially parallel to each other in plan and parallel to the cover (36) in plan The segment (30) is secured with mounting screws (23) on the face surface (49) that is proximate to the cover. In addition, the sub-structure (22) is defined by a terminating surface (51) with which it lies on an inside wall (52) of the interior space (44) that is enclosed by the rotary slide (2). This terminating surface (51) is configured essentially in the form of a circular arc and only on its lower end (53) that faces away from the bottom (3) does it have a flattened area that defines an airway (54).

On the one hand, this airway (54) is connected through an airline (55) to the metering container (12) and, on the other, through an intermediate space (56) with an air inlet connector (57) through which compressed air can be introduced into the intermediate space (56) and thus, through the airway (54) and the airline (55), into the metering container (12). To this end, there is an opening (59) in an upper part (58) that defines the bottom (3) relative to the metering container (12), through which the compressed air can be distributed through a trough that is formed in the bottom (3). Because of this even distribution of the compressed air, the product (19) is driven out of the metering container (12) when this is pivoted towards the outlet connector (18). The intermediate space (56) accommodates the pinion (20) and the toothed rack (21). Furthermore, sufficient free space through which the compressed air can escape towards the airway (54) is left. This compressed air is drawn from a source 105 that is connected to the air inlet connector (57). The inlet cross section (15) lies Vertically beneath a filling station or product admitting means (62) through which the product (19) can fall freely through the inlet cross section (15) and into the metering container (12). As soon as this metering container (12) is filled, the rotary slide (2) is pivoted about its longitudinal axis (5) so that the inlet cross section (15) is turned towards the outlet connector (18). Now the product (19) can fall freely through the outlet connector (18) into the packaging unit (60).

The product (19) passes to the filling station (62) through a metering system (63). This consists of a conveyor (64) and a metering hopper (65), from which a metered quantity of a product (19) falls down to the conveyor (64) In this way, it is ensured that the conveyor (64) only acts on the product (19) for a limited amount of time, until this is moved to the filling station (62).

The metering hopper (65) is filled with the help of a tilting hopper (66) that has a dispensing pipe (67) from which the product (19) is filled into the metering hopper (65). At an outer end (68) that is adjacent to the metering hopper (65) the tilting hopper (66) is supported so as to be able to rotate about a tilting bearing (69). This tilting bearing (69) is secured to a base plate (70) of the pivoting hopper (66), at the end (71) of which that is remote from the tilting bearing (69) a tilt drive (72) is hinged. When the tilting hopper (66) is in a tilted position (73), the dispensing pipe (67) runs in a direction (74) that dispenses the product (19) to the metering hopper (65). This runs essentially downwards so that the product (19) slides from the dispensing pipe (67) towards the metering hopper (65) as a result of its own weight. When this happens, the product (19) is bounded on the one hand by the base plate (70) and, on the other, by the walls (75) which when the tilting hopper is tilted are oriented downwards towards the metering hopper (65). In this tilted position, the product (19) that is in the dispensing pipe (67) and in an adjacent feed area (76) that is adjacent thereto in the direction of the base plate (70) leaves the dispensing pipe (67) in the direction of the metering hopper (65).

With the tilting hopper (66) in the pivoted state (73) the product that is outside the dispensing pipe (67) lies against the side wall (77), into which the wall (75) of the dispensing pipe (67) opens. When the tilting hopper (66) is tilted (73) this side wall (77) has its highest point (78) in the area of the dispensing pipe (67) and extends from this obliquely downwards in a direction away from the dispensing pipe (67). It defines a hopper space (79), on the side of which that faces away from the side wall (77) the base plate (70) runs onto the side wall (77) with a slightly tilted upper section (80). This upper section (80) has an upper edge (81) that is remote from the tilt bearing (69) and is connected through an upper terminating plate (82) to the side wall (77) and together with the side wall forms a storage space in which the product (19) that is not in the run-in area of the feed area (76) is stored.

The lower portion of the base plate (70) that is proximate to the tilt bearing (69) defines the dispensing pipe (67). The bend in the direction of the upper section (80) first occurs above the feed area (76). At this point, the upper section is angled at an obtuse angle relative to the lower section of the base plate (70).

When the tilting hopper (66) is not tilted, the dispensing pipe (67) is inclined slightly upwards so that the lower part of the base plate (70) extends downwards to a lowest point (83) from the tilting bearing (69) and defines a hopper space (79) with the obtusely angled upper section (80) that begins at the lowest point (83); the product (19) falls into this space (79) when the tilting hopper (66) is tilted. In this way, it fills the feed area (76) and a part of the dispensing pipe (67) again, from which, when the tilting hopper (67) is next tilted, the product (19) again flows out towards the metering hopper (65).

In the untilted state (84) the hopper space (79) is filled. Once the metering hopper (65) has been emptied, the tilting hopper (66) is pivoted about the tilting bearing (69), in that the tilt drive (72) is activated. When this is done, the product (19) that is in the feed area (76) moves into a position from which it can flow down through the dispensing pipe (67) and into the metering hopper (65) because of its own weight. Once the product (19) lying in the area of the dispensing pipe (67) and the feed area (76) has moved towards the metering hopper (65), the tilting hopper (66) is once again tilted about the tilting bearing (69), so that once again the feed area and the essential parts of the dispensing pipe (67) can be filled with the product (19), which when the tilting hopper (66) was in the tilted position was in the area of the side wall (77).

We claim:

1. An apparatus for non-damaging packaging of a flowable product whose consistency can be affected by outside influences, comprising a housing; a metering container mounted in said housing for rotation about a predetermined axis between a first and second position, said container having an inlet which admits a product into the container by gravity in said first position and discharges the product from the container by gravity in said second position of the container, said container further having a bottom which is movable toward and away from said inlet to thereby vary the quantity of product which can enter the container through said inlet; means for rotating said container between said positions; and means for moving said bottom relative to said inlet in directions substantially transversely of said axis, said moving means being carried by said housing and being rotatable about said predetermined axis.

2. The apparatus of claim 1, wherein said moving means comprises a slide drive.

3. The apparatus of claim 2, wherein said slide drive comprises a rotary shaft extending from said housing.

4. The apparatus of claim 3, said drive further comprising a coupling connecting said shaft with said bottom.

5. The apparatus of claim 3, wherein said moving means comprises a toothed rack which is connected to said bottom and mates with a pinion which is rotatable with said shaft.

6. The apparatus of claim 1, further comprising means for guiding said movable bottom in said housing.

7. The apparatus of claim 6, wherein said means for guiding the bottom comprises walls forming part of said housing.

8. The apparatus of claim 1, wherein said bottom comprises a substructure which is guided in said housing.

9. The apparatus of claim 8, wherein said substructure is guided by a guide plate which is rotatable in said housing with said metering container.

10. The apparatus of claim 9, wherein said guide plate is coupled to a toothed rack of said moving means by a tongue-and-groove connection which is essentially parallel to the directions of movement of said bottom.

11. The apparatus of claim 10, wherein said guide plate is rotatably mounted on a drive shaft of said moving means.

12. The apparatus of claim 9, wherein said guide plate is essentially parallel to a cover which closes an opening provided in said housing and communicating with an interior space of the housing, and further comprising a slide disposed in and rotatable in said space, said metering container being provided in said slide.

13. The apparatus of claim 12, wherein said interior space is essentially cylindrical, said housing having an inner wall which surrounds said interior space.

14. The apparatus of claim 12, wherein said metering container has a second axis transverse to said predetermined axis.

15. The apparatus of claim 12, wherein said slide has a cylindrical inner wall and said substructure is movable relative to said inner wall.

16. The apparatus of claim 15, wherein said substructure has an outer terminating surface which is engageable with said inner wall to limit the extent of movability of said bottom away from said inlet.

17. The apparatus of claim 16, wherein said metering container has a second axis transverse to said predetermined axis and said substructure has lateral boundaries adjacent said outer terminating surface and essentially parallel to said second axis, said slide having side walls essentially parallel to said second axis and adjacent said lateral boundaries.

18. The apparatus of claim 17, wherein said side walls define an inner space within said slide.

19. The apparatus of claim 18, wherein said side walls have essentially parallel faces.

20. The apparatus of claim 18, wherein said inner space has a first height and said bottom has a second height at least approximating said first height.

21. The apparatus of claim 1, wherein said bottom has a substructure and said moving means comprises a toothed rack secured to said substructure.

22. The apparatus of claim 21, wherein said metering container has a second axis normal to said predetermined axis and said toothed rack is essentially parallel to said second axis.

23. The apparatus of claim 22, wherein said moving means further comprises a pinion mating with said rack and rotatable about an axis perpendicular to said second axis.

24. The apparatus of claim 23, wherein said moving means further comprises means for rotating said pinion including a drive shaft which is coaxial with said pinion.

25. The apparatus of claim 1, wherein said bottom has a substructure and further comprising an airline extending into said metering container through said substructure.

26. The apparatus of claim 1, wherein said bottom has a substructure having a surface which confronts a cover of said housing, said moving means comprising a toothed rack secured to said surface of said substructure.

27. The apparatus of claim 1, wherein said bottom has a substructure and said moving means comprises a toothed rack affixed to said substructure and a pinion mating with said rack, said rack and said pinion being disposed in a space between said substructure and a cover of said housing.

28. The apparatus of claim 27, wherein said housing has an air inlet communicating with said space.

29. The apparatus of claim 28, further comprising an airline extending through said bottom and communicating with said space.

30. The apparatus of claim 1, wherein said housing includes a cover and said moving means comprises a drive shaft and a guide plate rotatably supporting said shaft and having a guide piece rotatably mounted in said cover.

31. The apparatus of claim 30, wherein said guide plate has a side which lies against said cover.

32. The apparatus of claim 31, wherein said guide plate consists of a first material and said cover consists of a second material.

33. The apparatus of claim 32, wherein said cover consists of steel and said guide plate consists of brass.

34. The apparatus of claim 1, wherein said moving means includes a toothed rack secured to said bottom, a pinion mating with said rack and having a rotary shaft extending from said housing, and a hand wheel affixed to said shaft outside of said housing.

35. The apparatus of claim 34, further comprising a spring which biases said hand wheel in the direction of the axis of rotation of said shaft.

36. The apparatus of claim 1, wherein said means for rotating said container comprises a slide rotatably mounted in and having a portion extending from said housing, said housing having a bearing for said slide.

37. The apparatus of claim 36, wherein said means for rotating said container further comprises means for rotating said portion of said slide.

38. The apparatus of claim 37, wherein said means for rotating said portion of said slide comprises a drive pinion.

39. The apparatus of claim 1, further comprising means for admitting the product into said inlet, said product admitting means being disposed above said inlet in the first position of said metering container.

40. The apparatus of claim 39, further comprising a product metering system connected with said product admitting means.

41. The apparatus of claim 40, further comprising a metering hooper which dispenses the product into and is disposed above said metering system.

42. The apparatus of claim 41, further comprising a filling hopper having a dispensing pipe disposed above and arranged to admit the product into said metering hopper.

43. The apparatus of claim 42, wherein said filling hopper is tiltable to admit the product into said metering hopper through said dispensing pipe.

44. The apparatus of claim 43, wherein said filling hopper is tiltable at one end of said dispensing pipe.

45. The apparatus of claim 43, further comprising means for tilting said filling hopper.

* * * * *